US010527263B2

(12) United States Patent
Kalnins

(10) Patent No.: US 10,527,263 B2
(45) Date of Patent: Jan. 7, 2020

(54) MODULAR LIGHTING SYSTEM

(71) Applicant: Guntis Kalnins, Riga (LV)

(72) Inventor: Guntis Kalnins, Riga (LV)

( * ) Notice: Subject to any disclaimer, the term of this patent is extended or adjusted under 35 U.S.C. 154(b) by 0 days.

(21) Appl. No.: 16/318,230

(22) PCT Filed: Mar. 17, 2017

(86) PCT No.: PCT/IB2017/051562

§ 371 (c)(1),
(2) Date: Jan. 16, 2019

(87) PCT Pub. No.: WO2018/104798

PCT Pub. Date: Jun. 14, 2018

(65) Prior Publication Data

US 2019/0226663 A1 Jul. 25, 2019

(30) Foreign Application Priority Data

Dec. 8, 2016 (LV) ..... P-16-94

(51) Int. Cl.
*F21V 21/005* (2006.01)
*F21V 23/06* (2006.01)
(Continued)

(52) U.S. Cl.
CPC ..... *F21V 21/005* (2013.01); *F21S 4/28* (2016.01); *F21V 19/001* (2013.01);
(Continued)

(58) Field of Classification Search
CPC ..... F21V 21/005; F21V 21/00; F21V 21/28; F21V 23/06; F21V 19/009;
(Continued)

(56) References Cited

U.S. PATENT DOCUMENTS 5,337,225 A * 8/1994 Brookman ..... F21S 8/032 362/145
5,559,681 A * 9/1996 Duarte ..... F21V 21/08 362/231
(Continued)

FOREIGN PATENT DOCUMENTS

DE 202006013810 U1 11/2006
DE 202014104847 U1 12/2014
(Continued)

*Primary Examiner* — Erin Kryukova
(74) *Attorney, Agent, or Firm* — Smartpat PLC

(57) ABSTRACT

A modular lighting system comprises a plurality of LED modules and a plurality of connecting modules intended for the creation of three-dimensional constructions. The LED modules comprise an elongated cylinder-shaped body made of translucent electrically insulating polymer material. A longitudinally upper opening and a lower opening with flat elongated cross-section shape are located one above the other. The inner surface of both openings is electrically conductive through the entire length of the openings, creating electrically interconnected upper and lower electrical sockets. The LED module is connected to a connecting module, which comprises an upper and a lower connecting element. The upper connecting element is a flat metal one-piece part. It consists of a base part and three same-size pins located around its perimeter, the sizes of which correspond to the sizes of LED module sockets. The lower and upper connecting elements are identical and can be fastened together.

13 Claims, 9 Drawing Sheets

(51) Int. Cl.

| | |
|---|---|
| ***F21S 4/28*** | (2016.01) |
| ***F21V 19/00*** | (2006.01) |
| ***F21Y 103/00*** | (2016.01) |
| ***F21Y 115/10*** | (2016.01) |

(52) U.S. Cl.
CPC ..... *F21V 19/009* (2013.01); *F21V 19/0085* (2013.01); *F21V 23/06* (2013.01); *F21Y 2103/00* (2013.01); *F21Y 2115/10* (2016.08)

(58) Field of Classification Search
CPC ..... F21V 19/0085; F21V 19/001; F21S 4/28; F21K 9/238; F21Y 2103/00; F21Y 2115/10
See application file for complete search history.

(56) References Cited

U.S. PATENT DOCUMENTS

| | | | | |
|---|---|---|---|---|
| 6,113,248 | A * | 9/2000 | Mistopoulos | F21V 23/06 362/219 |
| 6,341,875 | B1 * | 1/2002 | Chu | F21V 19/006 362/249.06 |
| 7,034,230 | B2 * | 4/2006 | Fan | F21S 4/24 174/117 F |
| 8,371,894 | B1 | 2/2013 | Rosen et al. | |
| 8,764,507 | B2 | 7/2014 | Lin | |
| 10,274,180 | B2 * | 4/2019 | Shine | F21V 23/06 |
| 2009/0047863 | A1 | 2/2009 | Capriola | |
| 2011/0013406 | A1 | 1/2011 | Kuo | |
| 2012/0201021 | A1 * | 8/2012 | Todd | F21S 2/005 362/217.02 |
| 2015/0233533 | A1 * | 8/2015 | Van Es | F21V 21/005 313/49 |

FOREIGN PATENT DOCUMENTS

| | | | |
|---|---|---|---|
| RU | 83649 | U1 | 6/2009 |
| RU | 115041 | U1 | 4/2012 |

* cited by examiner a b c a b c

MODULAR LIGHTING SYSTEM

TECHNICAL FIELD

The invention relates to a modular lighting system, comprising a plurality of LED modules and a plurality of connecting modules intended for the creation of three-dimensional constructions, and can be used both in relatively small light module construction kits intended for entertainment and in large modular lighting systems.

BACKGROUND

There is a known modular lighting system [DE202014104847 U1], which consists of elongated light modules with a created light segment, which comprises a lamp or a luminescent element, and a connecting element. With the help of these connecting elements the light modules are connected around the central axis to the symmetrical connecting elements, which ensure the mechanical and electrical interconnection of the light modules. The connecting element can be joined to the light segment of the light module with a hinge or an elastic rubber part. The device deficiency of this system is in the limitations to the creation of constructions, which are determined by the fact that the connecting elements of the system use the principle of radial addition of the light modules, which, despite the freedom of movement of the light modules in the hinge or elastic part, impedes the creation of constructions with parallel placing of elongated light modules, therefore strongly limiting the types of constructions to be made. The device deficiency is also in the complicated structure of the light modules and connecting modules used in the lighting system, particularly in the light modules constructed with a hinge or elastic rubber part.

The closest to the proposed invention is the light module construction kit which is described in U.S. Pat. No. 8,371,894 B1. It comprises a plurality of luminescent and non-luminescent modules of different shapes and sizes. The luminescent module contains at least one light-emitting element, which is electrically connected to more than one socket located in the module. Non-luminescent modules have couplers, which mechanically and electrically interconnect the luminescent modules. This type of socket and coupler connection has the freedom of movement, rotating around the connection axis, which gives a certain freedom in putting together different constructions.

However, the device deficiency of this construction kit is that with this type of socket and coupler connection between modules, it is not possible to change the angle of the curved surface and shape of the three-dimensional constructions made of particular modules, which largely restricts the diversity of three-dimensional constructions to be made. This creates the need for a large number of differently shaped modules, which, in conjunction with the complexity of the structure of such type of modules, particularly when the number of sockets in the light module or the number of couplers in the connecting module is higher than two, makes the production thereof significantly more difficult.

SUMMARY

The technical task fulfilled by the proposed invention is the simplification of the module construction of a modular lighting system, the simplification of production thereof, as well as the diversification of modular lighting system constructions created from modules, including from the same particular modules.

In accordance with the invention, a modular lighting system is proposed, comprising a plurality of LED modules and a plurality of connecting modules, wherein each LED module comprises an elongated body made of translucent and electrically insulating polymer material, said body along the longitudinal axis has a uniform shape of cross-section at least in the middle section, upper openings and lower openings of rectangular cross-section are arranged along the longitudinal axis one above the other on each end of the body, and the shape and size of the cross-section of the upper openings on the one end of the body corresponds the shape and size of the cross-section of the upper openings on the other end of the body, but the shape and size of the cross-section of the lower opening on one end of the body corresponds the shape and size of the cross-section of the lower opening on the other end of the body, while the distances between the longer edge of the cross-section of the upper opening and the longer edge of the cross-section of the lower opening throughout the length of the openings and on both ends of the body are the same, and the internal surface of these openings is at least partially made to be electrically conductive, creating electrical sockets and the upper socket located on one end is electrically connected with the upper socket located on the other end, while the lower socket located on one end is electrically connected with the lower socket located on the other end, while inside the body at least one LED element is located, which is directly or indirectly electrically connected to the electrical conductor material of the upper sockets and to the electrical conductor material of the lower sockets, whereas each connecting module comprises two corresponding with each other one-piece connecting elements made from metal sheet and intended for electrical and mechanical connection of LED modules, each of said connecting elements having at least three bendable pins, and the shape of the pins of the upper connecting element corresponds to the shape and size of the upper sockets of the LED module, while the shape of the pins of the lower connecting element corresponds to the shape and size of the lower sockets of the LED module.

The placement of sockets with rectangular cross-section on both sides of the LED module in parallel one above the other (placement indications upper and lower socket are relative, because the LED element, when making the construction, can be turned at any angle) allows to simplify connecting these modules, because it permits interconnecting the LED modules in the entire three-dimensional construction of the modular lighting system in two (upper and lower) planes with two connecting elements which are very simple and very easily made out of flat metal sheets, which can be of different shapes, the number of pins and their placement around the base part of the pins.

Thanks to the ductile properties of the metal and the flat shape of the pins of the connecting element, the pins can be bended upwards or downwards in relation to the plane of the base part of the connecting element. This permits to create three-dimensional constructions of the modular lighting system also with curved surfaces, by bending pins prior or during the assembly of the construction, as well as allows to create, from the same particular LED modules and connecting modules, three-dimensional constructions of the modular lighting system of different types and sizes, the surfaces of which can be with different angle and shape of the curved surface, which can be changed by changing the angle of pins bend.

The proposed modular lighting system is particularly efficient if the height of the LED module sockets and the height of the pins of the corresponding connecting elements is between 0.3 and 3.0 mm, the width of the LED module sockets is at least 3 times bigger than the height of the sockets, and the width of the pins of the corresponding connecting elements is at least 3 times bigger than the height of the pins, the length of the pins of the connecting elements is at least 2 times bigger than the width of the pins, and the length of the LED module is at least 2 times bigger than the length of the pins of the connecting elements. The height of the pins influences the other sizes and determines the dimensions of the LED modules, and they can range in size from a construction kit of small LED modules to a big lighting system. The width of sockets and pins has to be at least 3 times bigger than their height, because this ratio ensures the resilience of the created three-dimensional construction against deformations should the pins be bent sideways (in the plane of the connecting element). The length of the pins has to be at least 2 times bigger than the width, so that the pins may be securely held in the intended sockets.

The upper and lower openings of the LED modules can extend through the entire length of the LED module. Such constructive solution simplifies LED modules and their production accordingly, because one does not have to create two separate upper sockets and two separate lower sockets and their electrical connection, only one upper and one lower opening with surfaces made of materials conducting electricity throughout their length.

The upper and lower sockets of LED modules can be made of different width. Correspondingly, the pins of the connecting elements of the connecting modules are of different width that nevertheless corresponds the width of corresponding sockets. Such solution facilitates the assembly of constructions and precludes incorrect electrical assembly, in particular if the pins of one width are joined to one pole of the source of electric power supply, and the pins of a different width—to the other pole.

The cross-section of the LED module bodies can be circular in shape.

The cross-section of the LED module bodies can be polygonal in shape.

Although the pins fixed in the sockets of LED modules hold both connecting elements of the connecting module at a certain distance from each other, in cases when the surface area of the base parts of these connecting elements is large, there is a possibility for the base parts to deform and come in contact with each other. Then it is necessary to use an electrically insulating layer between the surfaces of the base parts of these connecting elements that are facing each other, which can be fastened to one or both of these surfaces and created both as an elastic electrically insulating material with a self-adhesive surface, and as a detail fashioned out of electrically insulating material which is fastened to the connecting element with special hook clamps, and as electrically insulating material made already in the production process.

The connecting elements of the connecting module can be fastened together with electrically insulating polymer material. The connecting module with fastened together connecting elements is necessary in order to create connecting modules of complex configuration, as well as it can be a supplementary visual element in the modular lighting system.

The surface of the ends of the LED module can be shaped at an angle to the longitudinal axis of the LED module. The LED module with beveled ends improves the design of the three-dimensional constructions, covering more of the metal connecting elements from their surface.

In the body of the LED module or on the surface of said body, one can place elements which change the optical transmittance of the body of the LED module. These can be elements intended to improve the light dispersion or to focus the luminous flux in a certain direction, as well as to create patterns and effects of different colors and brightness.

BRIEF DESCRIPTION OF THE DRAWINGS

The proposed invention is illustrated by the following figures depicting the examples of the construction of invention, which are not the only options possible. The figures depict.

DETAILED DESCRIPTION

Figure 1:
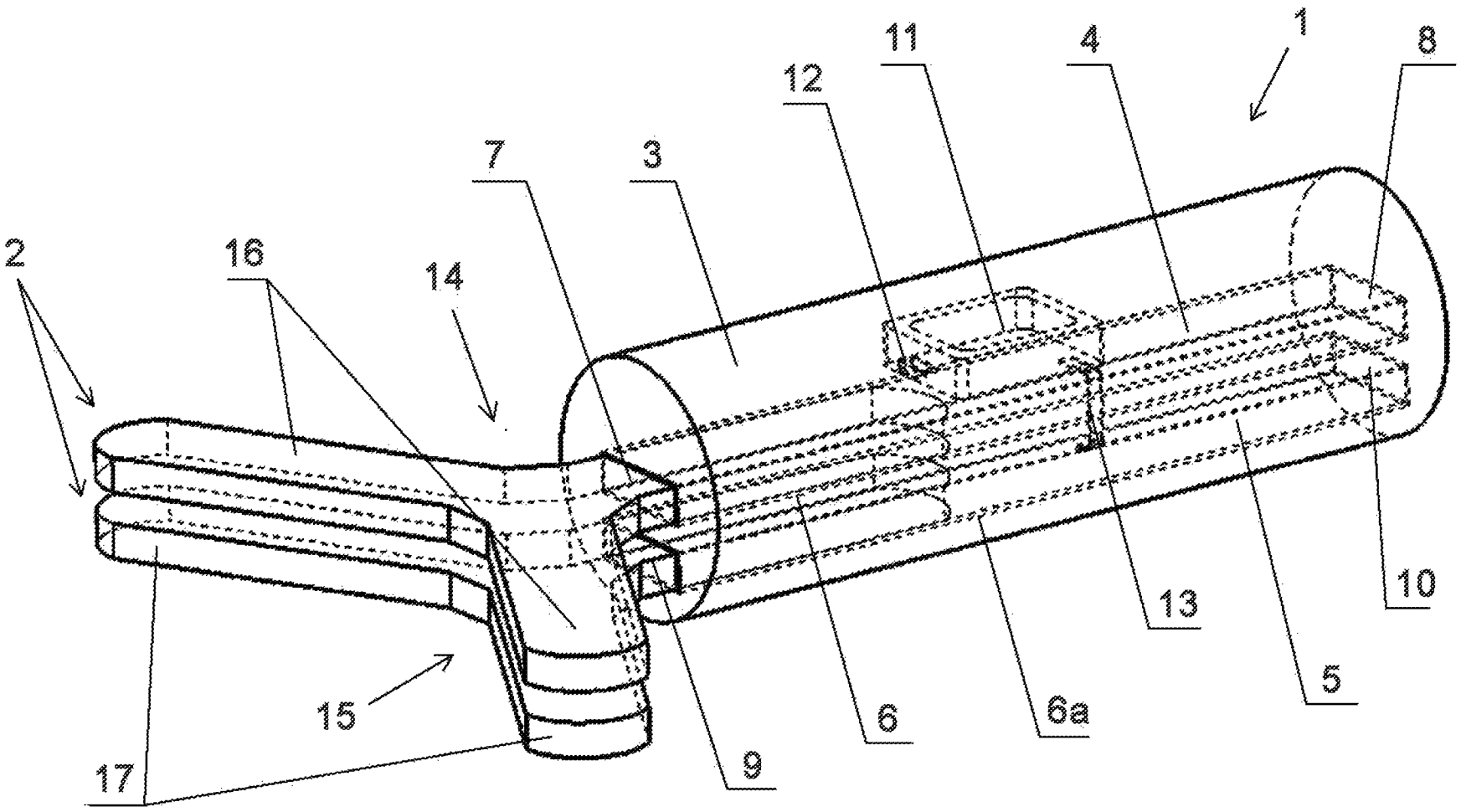
FIG. 1—one LED module and one connecting module connected with straight pins.
Figure 2:
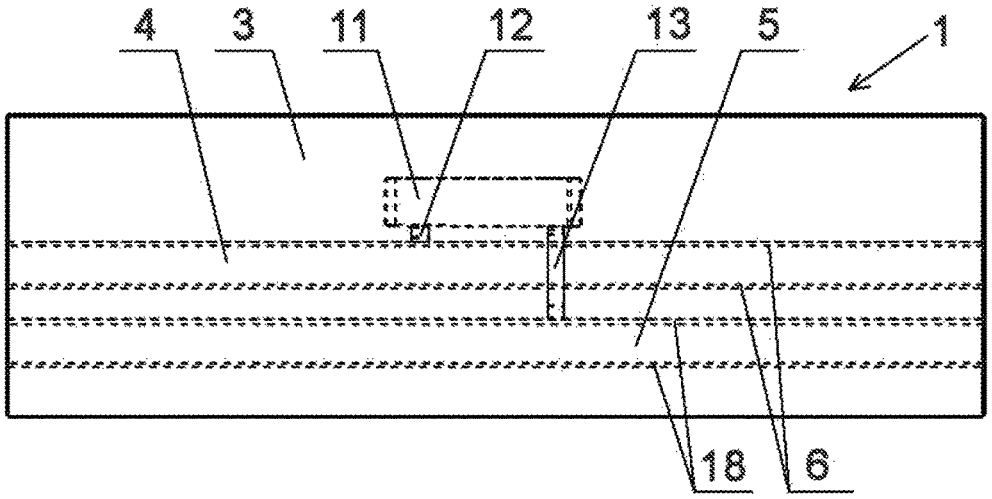
FIG. 2—first example of a LED module, a—side view, b—frontal view, c—perspective view.
Figure 2:
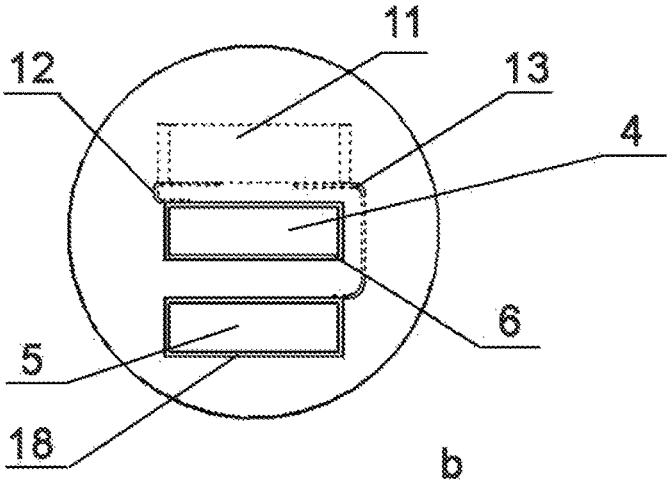
Figure 2:
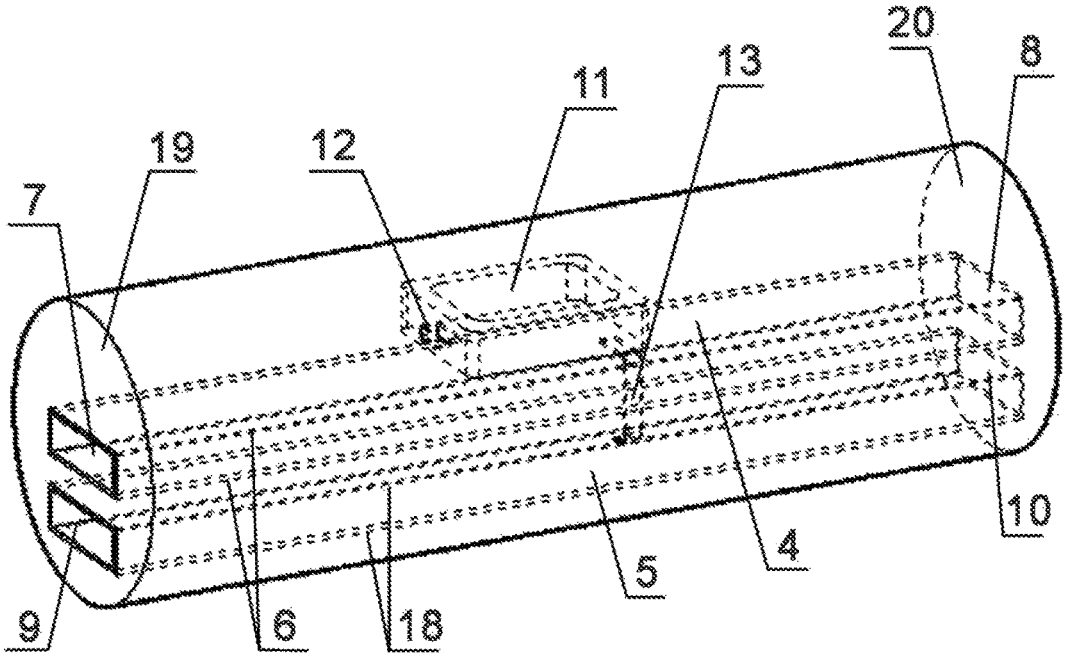

The proposed modular lighting system comprises LED modules 1 and connecting modules 2. FIG. 1 depicts one LED module 1 and one connecting module 2 in a connected state. FIG. 2 depicts the LED module depicted in FIG. 1, but without the connecting module. LED module 1 comprises an elongated cylinder-shaped body made of translucent electrically insulating polymer material 3. Along the longitudinal axis, throughout the entire length of the body of LED module 3, upper opening 4 and lower opening 5 are located one above the other, both with rectangular cross-section. The designation "upper" and "lower" for the openings is relative (in this example it is determined by the LED element located above the sockets), when creating a modular lighting system construction, LED module 1 can be turned at any angle. The distances between the longest edge of the cross-section of the upper opening 4 and the longest edge of the cross-section of the lower opening 5 are the same through the entire length of the openings, and the shape and size of the cross-section of both these openings 4, 5 are the same throughout their entire length. The inner surface of both openings 4, 5 throughout the entire length of the openings is made to conduct electricity, in this example out of metal foil 6, 18, therefore creating upper electrical sockets 7, 8 on both ends of the body of the LED module 19, 20, which are electrically connected to each other, and the lower electrical sockets 9, 10 on both ends of the body of the LED module 19, 20, which are electrically connected to each other.

Inside the body of LED module 3, one LED element 11 is located. A LED element is a light-emitting diode, in this example its construction is a LED SMD (surface-mount light-emitting diode), but instead of it LED die or ordinary LED in a shell with output can be used in the process of LED module 1 production. One output of LED element 11 with flat metal contact wire 12 is electrically connected to the electricity conducting material of the upper sockets—metal foil 6, but the other output with flat metal contact wire 12 is electrically connected to the electricity conducting material of the lower sockets—metal foil 18.

LED module 1 is connected to connecting module 2, comprising an upper connecting element 14 and a lower connecting element 15. Upper connecting element 14 is a flat metal one-piece part consisting of the base part of connecting element 23 and three same-size pins 16 located around its perimeter, the sizes of which correspond to the sizes of LED module sockets 7, 8, 9, 10. Lower connecting element 15 in this example is completely identical to the upper connecting element 14.

One of the three pins 16 of the upper connecting element 14 of the connecting module is placed in the upper socket 7 of the LED module 1, whereas one of the three pins 17 of the corresponding lower connecting element 15 is placed in the lower socket 9 of the LED module 1. For both connecting elements 14, 15, the two free pins 16 of the upper connecting element and the two free pins 17 of the lower connecting element are intended to connect with the upper sockets 7 and lower sockets 9 of two other LED modules 1, whereas on the other end 20 of the LED module 1, both sockets 8, 10 are intended to connect to pins 16, 17 of both connecting elements 14, 15 of other connecting module 2. Creating one electrical circuit through the pins 16 of the upper connecting elements 14 and the upper sockets 7, 8 of the LED modules, for example, an electric power supply circuit of positive polarity of all the connected LED modules 1, and creating another electrical circuit through the pins 17 of the lower connecting elements 15 and the lower sockets 9, 10 of the LED modules, for example, an electric power supply circuit of negative polarity of all the connected LED modules 1. With the connecting elements 14, 15 of the connecting modules 2, mechanical connection of LED 1 modules is ensured as well.

The connection of LED module sockets 7, 8, 9, 10 and pins 16, 17 of the connecting elements 14, 15 of the connecting module 2 can contain elements for mechanical fixation in position, both on the side of pins 16, 17 and of the sockets 7, 8, 9, 19 (not depicted in the figures).

The sizes of LED modules 1 and correspondingly connecting modules 2 of modular lighting systems can vary greatly, can be adjusted in order to create both relatively small light module construction kits intended for entertainment purposes and large modular lighting systems. In order to ensure that the pins 16, 17 of the connecting modules 2 are sufficiently flexible and that, at the same time, the created three-dimensional construction of the modular lighting system is sufficiently resistant to deformations, the sizes of sockets 7, 8, 9, 10 of LED modules 1 and of pins 16, 17 of connecting modules 2 must comply with the specific requirements:

The height of sockets 7, 8, 9, 10 of LED module 1 and the height of pins 16, 17 of corresponding connecting elements 2 should be between 0.3 and 3.0 mm;

The width of sockets 7, 8, 9, 10 of LED module 1 should be at least 3 times as big as the height of the sockets and the height of pins 16, 17 of corresponding connecting elements 2 should be at least 3 times as big as the height of the pins;

The length of pins 16, 17 of connecting elements 2 should be at least 2 times as big as the width of pins 16, 17, correspondingly the depth of sockets 7, 8, 9, 10 of LED modules 1 also should be at least as deep as the pins 16, 17 are long. Correspondingly the length of LED module 1 should at least match the length of 2 pins 16, 17.

Figure 3:
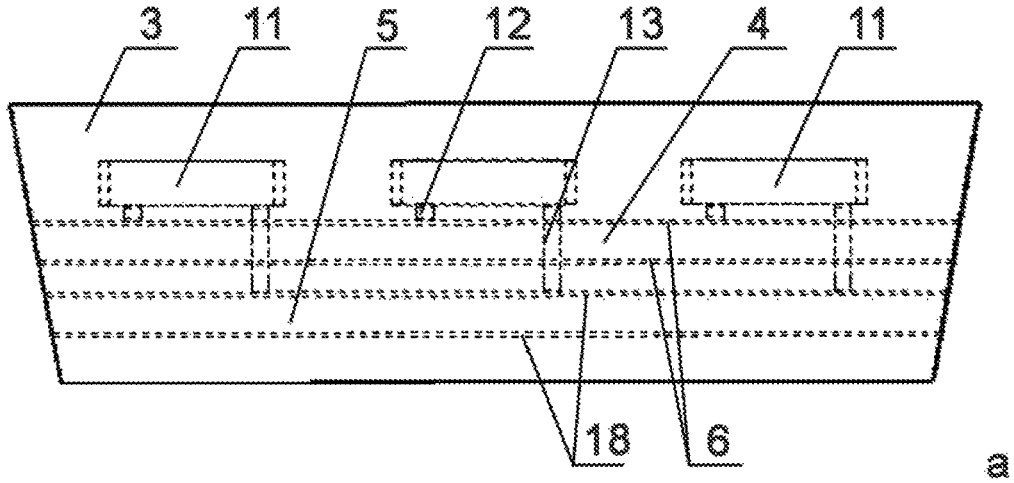
FIG. 3—second example of a LED module, a—side view, b—frontal view, c—perspective view.
Figure 3:
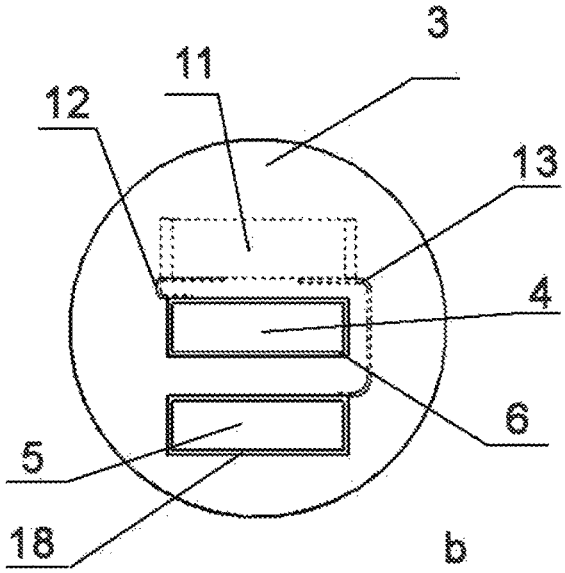
Figure 3:
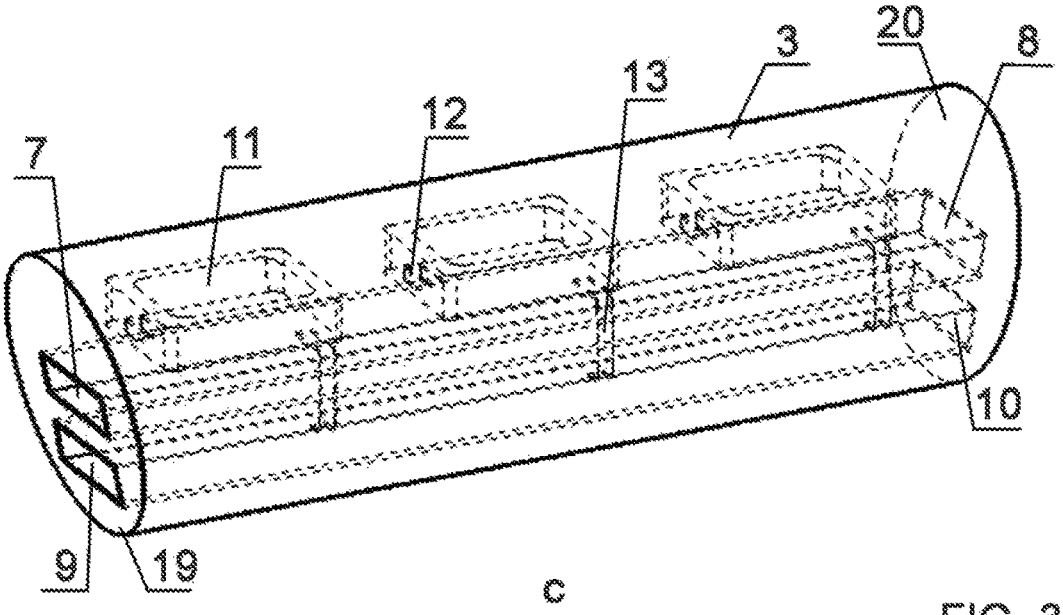

FIG. 3 depicts another example of a LED module. LED module 1 comprises an elongated cylinder-shaped body made of translucent electrically insulating polymer material 3, with both ends 19, 20 created at an angle in relation to the longitudinal axis of LED module 1. In LED module 1, along the longitudinal axis and throughout its entire length, upper opening 4 and lower opening 5 are located one above the other, both with unchanging rectangular cross-section shape and size. The distances between the longer edge of the cross-section of the upper opening 4 and the longer edge of the cross-section of the lower opening 5 throughout the length of the openings are the same, and the shape and size of the cross-section of both these openings 4, 5 are the same. The internal surface of these openings 4, 5 throughout the length of the openings is made to conduct electricity, in this case out of metal foil 6, 18, therefore creating upper electrical sockets 7, 8, on both ends 19, 20 of the LED module 1, which are electrically connected to each other, and lower electrical sockets 9, 10 on both ends 19, 20 of the LED module 1, which are electrically connected to each other.

Inside the body 3 of LED module 1, three LED elements 11 are located, where one output of each LED element 11 with flat metal contact wire 12 is electrically connected to the metal foil 6 conducting electricity in upper sockets 7, 8 and another output of the LED element 11 with flat metal contact wire 13 is electrically connected to the material conducting electricity in the lower sockets 9, 10—metal foil 18. In this example, both ends 19, 20 of the body 3 of the LED module 1 are at an angle to the longitudinal axis of the LED module 1, thus elongating the top part of the body 3 of the LED module 1 in relation to the bottom part, thus permitting to better cover the metallic connecting elements 14, 15 of the connecting module 2 from the surface of LED modules 1 in different types of modular lighting system constructions. The difference in the construction of the other example of LED module 1 is in the fact that it comprises three LED elements 11 located evenly throughout its length, thus improving the homogeneous distribution of light brightness of LED module 1 through its entire length, which can be important when creating modular lighting system constructions. The number of LED elements 11 in the LED module 1 can also be bigger than three and mainly depends on the length of LED module 1 and the desired degree of light alignment on the surface of LED module 1.

Figure 4:
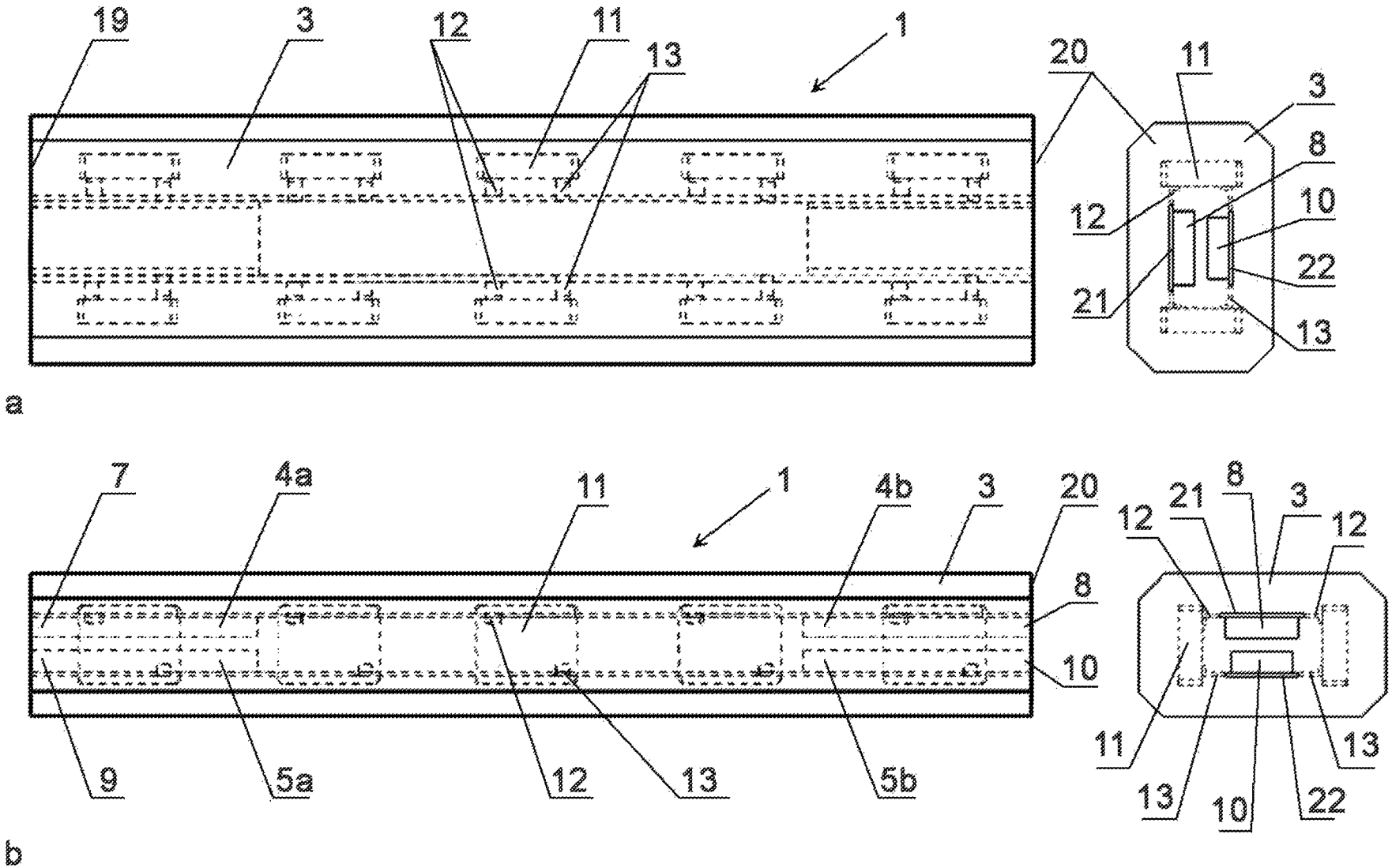
FIG. 4—third example of a LED module, a—top view (with frontal view next to it), b—side view (with frontal view next to it)

FIG. 4 depicts the third example of a LED module. LED module 1 comprises an elongated body 3 of flat polygonal shape made of translucent electrically insulating polymer material, where along the longitudinal axis, on the one end 19 there are upper opening 4*a* and lower opening 5*a* located one above the other, while on the other end 20 of the body 3 of the LED module 1, along the longitudinal axis, there are upper opening 4*b* and lower opening 5*b* located one above the other. The shape and size of the cross-section of the upper opening 4*a* of the LED module 1 are the same as the shape and size of the cross-section of the upper opening 4*b*, while the shape and size of the lower opening 5*a* are the same as the shape and size of the cross-section of the lower opening 5*b*. The height of all openings 4*a*, 4*b*, 5*a*, 5*b* is the same, while their width is at least 3 times bigger than the height of these openings 4*a*, 4*b*, 5*a*, 5*b*, and the width of the upper openings 4*a* and 4*b* is approximately 20% bigger than the width of the lower openings 5*a* and 5*b*. The length of the openings 4*a*, 4*b*, 5*a*, 5*b* is approximately 3 times bigger than the width of the upper openings 4*a* and 4*b*. Different width of the upper openings 4*a*, 4*b* and lower openings 5*a*, 5*b* of the LED module 1 can simplify the assembly of complex modular lighting system constructions, because it prevents from mixing up the upper sockets 7, 8 and the lower sockets 9, 10 of LED module 1 when connecting them, which is important for preserving the power supply polarity. The distances between the longer edge of the cross-section of the upper openings 4*a*, 4*b* and the longer edge of the cross-section of the lower openings 5*a*, 5*b* throughout the length of the openings and on both ends 19, 20 of the body of the LED module are the same.

The upper internal surface of both upper openings 4*a*, 4*b* is covered with a material which conducts electricity—a one-piece upper metal strip 21, which is located through the entire length of the LED module body 3 and which connects both upper openings 4*a*, 4*b*, creating upper sockets 7, 8. Likewise, the lower internal surface of both lower openings 5*a*, 5*b* is covered with a material which conducts electricity—a one-piece lower metal strip 22, which is located through the entire length of the LED module body 3 and which connects both lower openings 5*a*, 5*b*, creating lower sockets 9, 10.

The width of both metal strips 21, 22 exceeds the area of the surface of the openings 4*a*, 4*b*, 5*a*, 5*b* they cover by approximately 10%. The parts of the edges of metal strips 21, 22 which exceed the width of the openings on both sides are fastened to the body 3 of the LED module 1, this ensuring additional fastening and preventing them from separating from the surfaces of the openings 4*a*, 4*b*, 5*a*, 5*b*, which they cover.

LED elements 11 are located along the longitudinal axis in LED module 1, with five LED elements 11 on both side edges of both metal strips 21, 22 conducting electricity in LED module 1. Such placement permits electrically connecting LED elements 11 to the upper and lower electrically conducting metal strip 21, 22 with ease using short electrically conducting metal connecting outputs 12, 13.

The increased number of LED elements 11 of the given LED module 1, their placement in two rows, as well as the minimal depth of openings 4*a*, 4*b*, 5*a*, 5*b* needed for connecting module pins 16, 17 and the polygonal shape of the cross-section of the LED module body 3 helps to improve the light dispersion and its homogeneity in such a LED module 1 with bigger dimensions. Likewise, light dispersion can be improved by the patterns or drawings created on the surface of the body 3 of the LED module, as well as light-reflecting elements located inside the body 3 of the LED module (not depicted in the figures).

The shape of the body 3 of LED modules 1 can be not just elongated with a polygonally shaped cross-section, as in the example, but also elongated with a cross-section of a more complex shape, its task, in conjunction with the specific arrangement of LED elements 11 and the use of reflective surfaces, can also be to focus light in certain directions (not depicted in the figures).

Likewise, with such a larger number of LED elements 11 in a LED module 1, LED elements can electrically connected to the sockets in series or combined circuits, and they can also contain additional control elements, for example, to limit the current and to switch among different colors of LED (not depicted in the figures).

Figure 5:
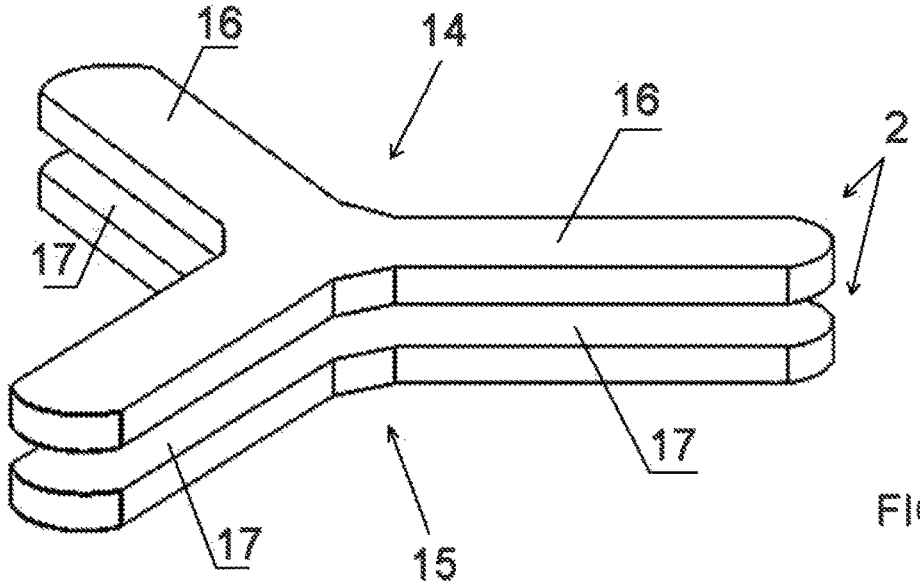
FIG. 5—connecting module, comprising an upper connecting element and a lower connecting element.

FIG. 5 depicts the connecting module 2, comprising the upper connecting element 14 with three pins 16 and the lower connecting element 15 with three pins 17. Both connecting elements 14, 15 are identical.

Figure 6:
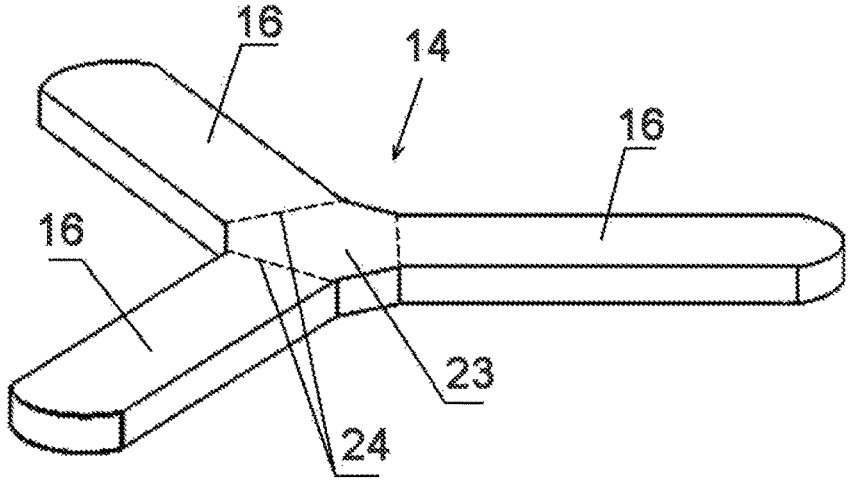
FIG. 6—one of the identical connecting elements of the connecting module depicted in FIG. 5.

FIG. 6 depicts one of the identical connecting elements 14, 15 of the connecting module 2 depicted in FIG. 5, in this case the upper connecting element 14, which is a one-piece part made of a metal sheet and which consists of the base part of the connecting element 23 and the 3 bendable pins 16 located around its perimeter. The line where the base part 23 of the connecting element 14 ends and the pins begins is also the intended pins bend line 24.

Figure 7:
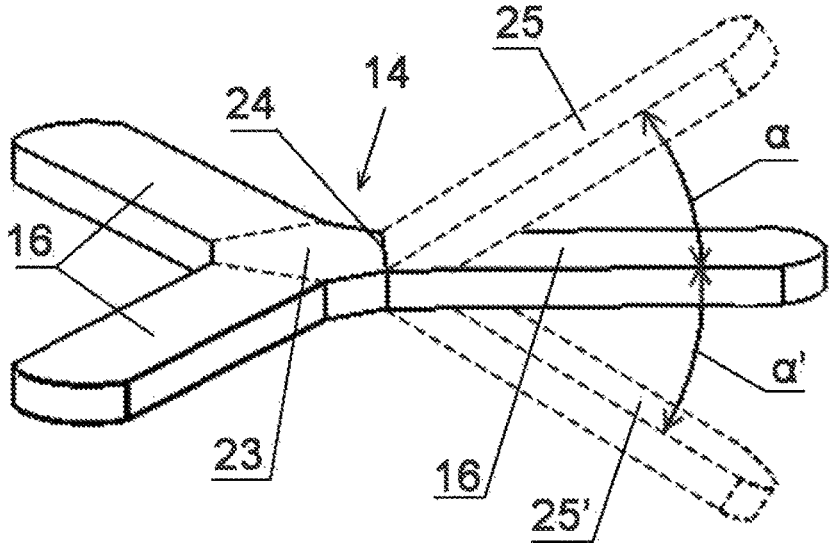
FIG. 7—upper connecting element, one of the pins thereof is bent along the pin bending line.

FIG. 7 depicts one pin 16 of the upper connecting element 14, which is bent along the pin bend line 24. Each specific pin 16 of the connecting element 14 can be bent both upwards (in the figure, at $\alpha$ angle) and downwards (in the figure, at $\alpha'$ angle), and its bend angle is the acute angle between the surface plane of the base part 23 of the connecting element, which coincides with the surface plane of the straight pin 16 of the connecting element, and the surface plane of the specific bent pin 16*a* or 16*b* of the connecting element. The width of the pins has to be at least 3 times bigger than their height, because this ratio ensures the resilience of the created three-dimensional construction against deformations, which would have been caused by the susceptibility of the pin to also be bent sideways (in the plane of the connecting element).

Figure 8:
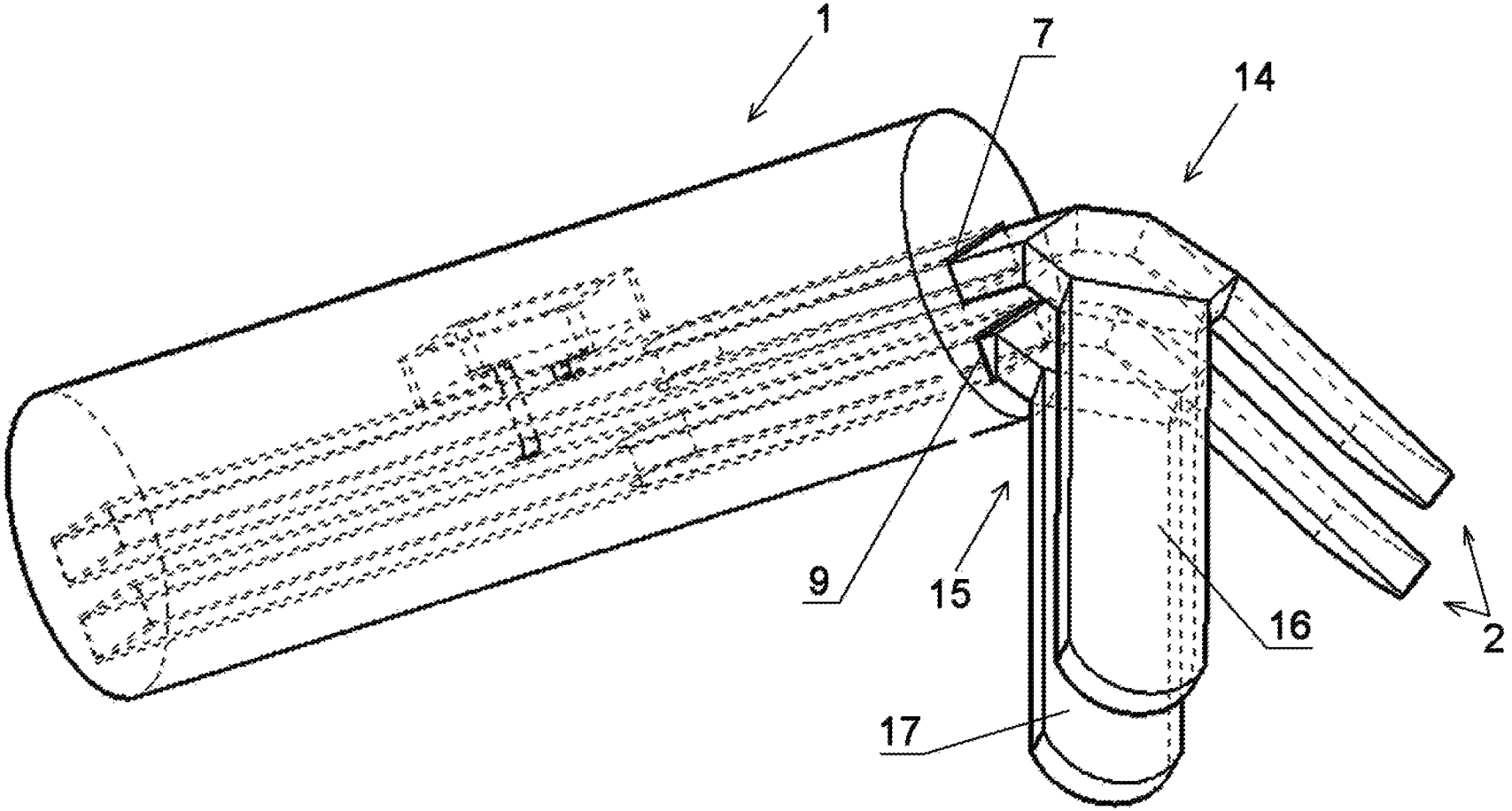
FIG. 8—one LED module and one connecting module connected with bent pins.

FIG. 8 depicts the connecting module 2, which comprises two connecting elements 14, 15 with already bent pins 16, 17, where same-direction pins 16, 17 of both connecting elements 14, 15 of the connecting module 2 are placed in the intended final position in the LED module 1. The connection process is begun by placing the corresponding pin 17 of the lower connecting element 15 of LED module 1 in the lower socket 9 until it reaches the final position. The pin 16 of the upper connecting element 14 has to be placed deep into the upper socket 7, so that the base part 23 of the upper connecting element 14 and pins 16, and the base part 23 of the lower connecting element 15 and pins 17 are in parallel one above the other. Since the sockets 7, 9 on one end of the connected LED module 1 already hold together both connecting elements 14, 15 of the connecting module 2, then pins 16, 17 of connecting elements 2 of other directions can be placed into the sockets 7, 9 of one end of each LED module being attached simultaneously. In cases when both connecting elements 14, 15 of the connecting module 2 are made to be connected or fastened together with a self-adhesive insulating layer (not depicted in the figures), the pins 16, 17 of connecting elements 14, 15 of the connecting module 2 of each specific direction are placed in the sockets 7, 9 of one end 19 of LED module 1 at the same time. To the already attached LED modules 1, on the other end 20, new connecting modules 2 are connected, and so on and so forth.

Figure 9:
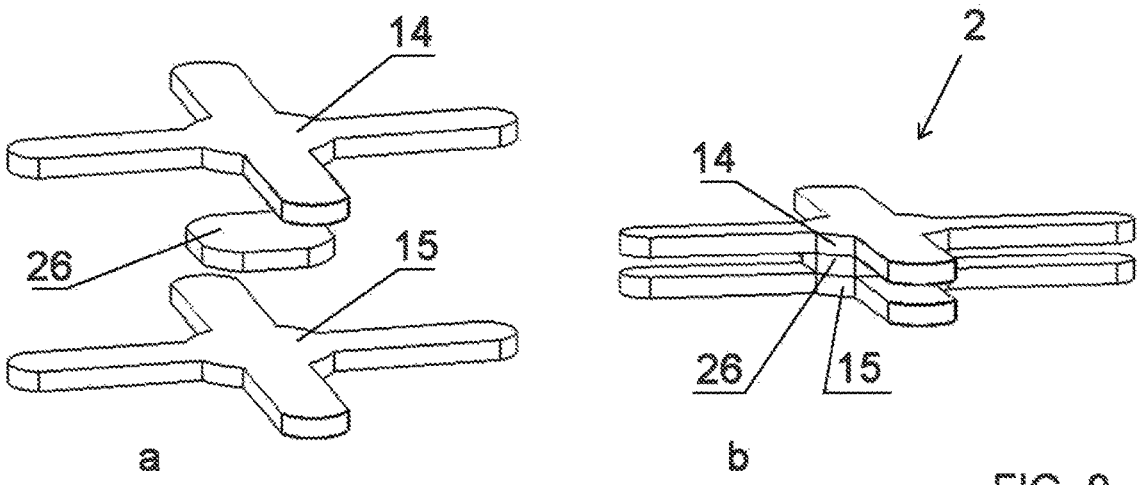
FIG. 9—connecting module with self-adhesive insulating spacer, a—not connected, b—connected.

FIG. 9 depicts connecting module 2 which comprises the upper connecting element 14 and the lower connecting element 15, and a self-adhesive insulating spacer 25. Said self-adhesive spacer 25 is made of an elastic insulating layer, for example, rubber, and one or both surfaces of it are coated with a sticky self-adhesive layer. FIG. 9*a* depicts a disassembled connecting module 2, while FIG. 9*b* shows both connecting elements 14, 15 as connected to each other with a self-adhesive insulating spacer 25. Such a self-adhesive insulating spacer 25 can be very easily made in a multitude of different shapes.

The insulating layer, in this example in the form of self-adhesive insulating spacer 25, in necessary between connecting elements 14, 15 in cases when the surface area of the base parts of these connecting elements 14, 15 is large and there is a chance that the base parts might be deformed and come in contact with each other, especially if the bend angle of the pins of connecting elements 14, 15 is big.

Figure 10:
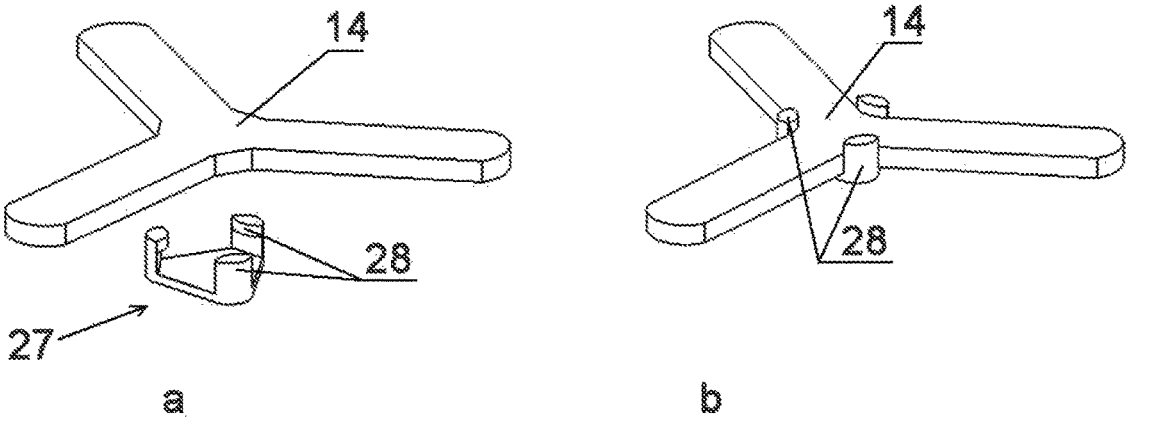
FIG. 10—connecting element of the connecting module with insulating spacer to be fastened, a—not connected, b—connected.

FIG. 10 depicts the upper connecting element 14 of the connecting module 2 with an attachable insulating spacer 26, which is made of electrically insulating material, for example, plastic. With special hook clamps 27 it is attached to the upper connecting element 14. The upper connecting element 14 is depicted in FIG. 10*a*—with non-attached attachable insulating spacer 26, and in FIG. 10*b*—with the attached one. Such an attachable insulating spacer 26 is easier to use than a self-adhesive insulating spacer 25 (which is depicted in FIG. 9), however, it is more difficult to make for different types of connecting elements. The attachable insulating spacer can also be with clamps on both sides, towards the sides of the connecting elements, in this way fastening the connecting elements together as well (not depicted in the figures).

Figure 11:
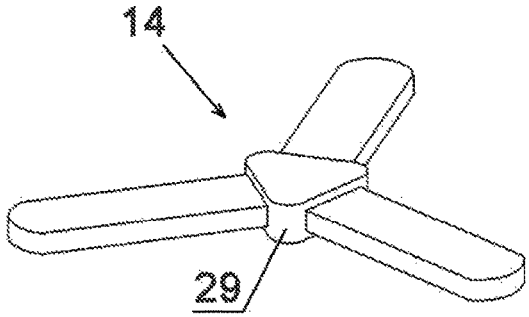
FIG. 11—connecting element of the connecting module with insulating layer in the base part made already during the production process.

FIG. 11 depicts the connecting element 14 of connecting module 2 with a layer of electrically insulating polymer material in the base part 28 of the connecting element, made already during the production process. Such a connecting element is easy to use and not difficult to manufacture. The electrically insulating polymer layer can also be applied to the base part partially, on one side (not depicted in the figures).

Figure 12:
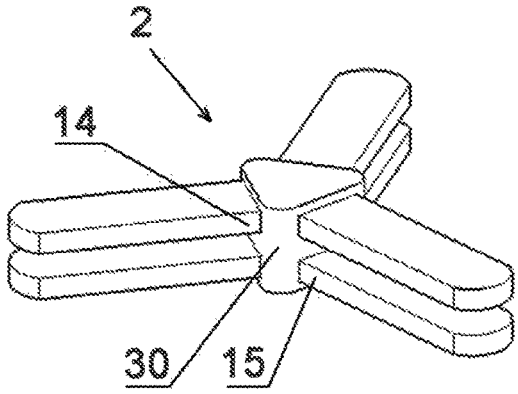
FIG. 12—connecting module where both connecting elements are fastened together already during the production process.

FIG. 12 depicts the connecting module 2, where both connecting elements 14, 15 are fastened together with electrically insulating polymer material 29 already during the production process. Such a connecting module 2 with already fastened connecting elements 14, 15 is appropriate in cases of complex direction placement of pins 16, 17.

Figure 13:
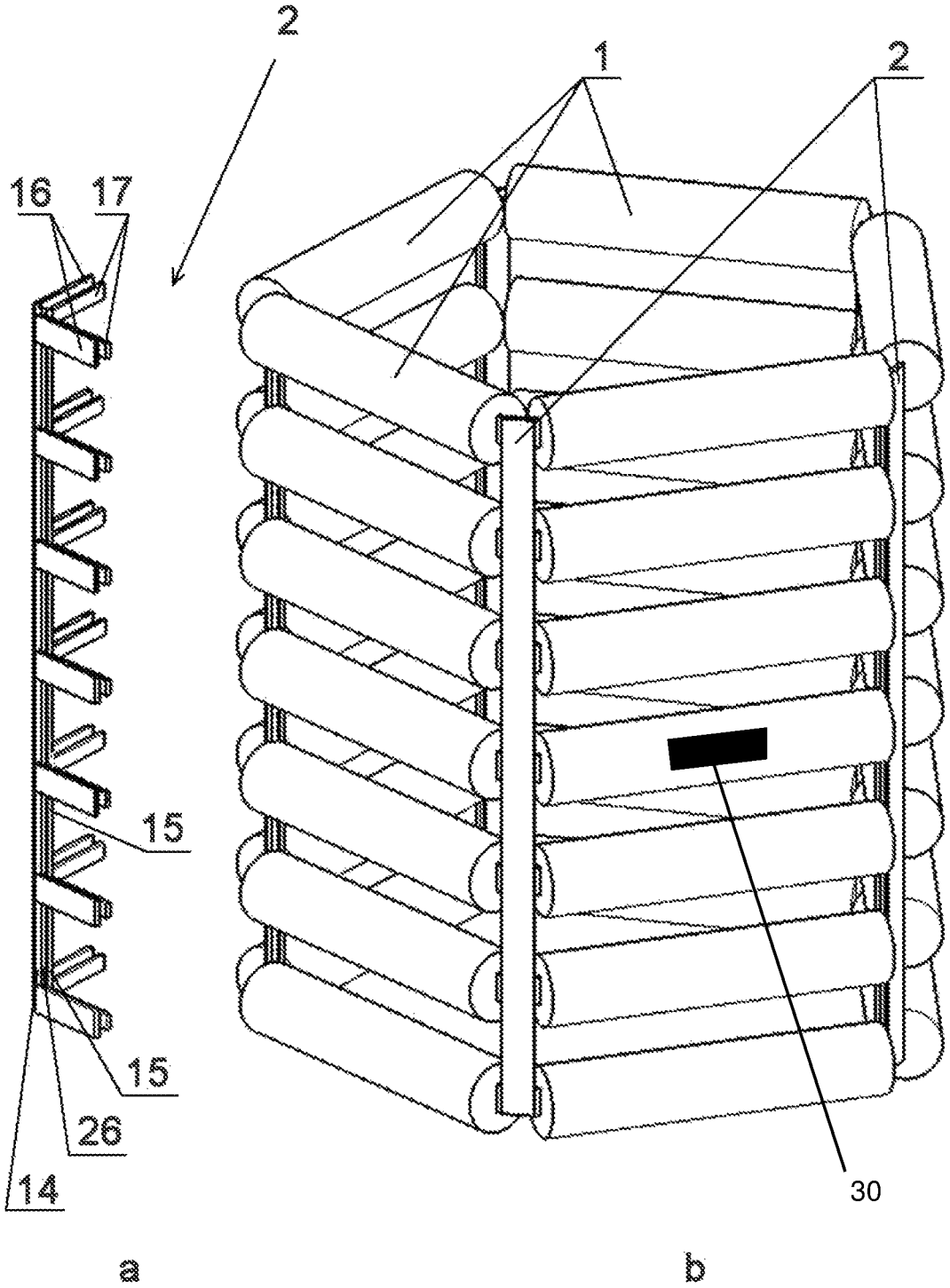
FIG. 13—first example of an assembled modular lighting system—three-dimensional construction in the shape of a pentagonal prism, a—the entire construction, b—only its connecting module.

FIG. 13*a* depicts an example of an assembled modular lighting system—three-dimensional construction in the shape of a pentagonal prism. It is made of cylinder-shaped LED modules 1 (the figure only depicts their outside shape) and connecting modules 2 (detailed depiction in FIG. 13*b*), which comprises special elongated connecting elements 14, 15 and self-adhesive insulating spacer 25. An element 30 is shown which changes the optical transmittance of the body of one LED module 1. Each connecting element 14, 15 comprises fourteen pins 16, 17, which are aimed in two directions from the elongated base part of connecting elements 14, 15 and bent at an approximately 33 degrees angle. Besides the width of the pins 16 of the upper connecting element is bigger than the width of the pins 17 of the lower connecting element. Both connecting elements 14, 15 are connected to each other with a self-adhesive insulating spacer 25 in the shape and size of the base part of the lower connecting element 15. One side of the spacer is glued to the upper surface of the base part of the lower connecting element 15, and the other—to the lower surface of the base part of the upper connecting element 14, thus fastening both connecting elements 14, 15 together. After that, to the free same-direction pins 16, 17 of both connecting elements 14, 15 of the connecting modules 2, LED modules 1 are attached, to the other end of which connecting elements 14, 15 are attached, and so on, and so forth.

Such elongated connecting elements 14, 15 of the connecting module 2 are easy to manufacture by cutting them out of a metal sheet. The length of connecting elements 14, 15 can be longer, correspondingly with a larger number of pins, and the length can be shortened by cutting such an elongated connecting element 14, 15 in the necessary place. It is also possible to change the bend angle of pins 16, 17 of connecting elements 2, which increases the diversity of constructions to be made of this modular lighting system kit.

Figure 14:
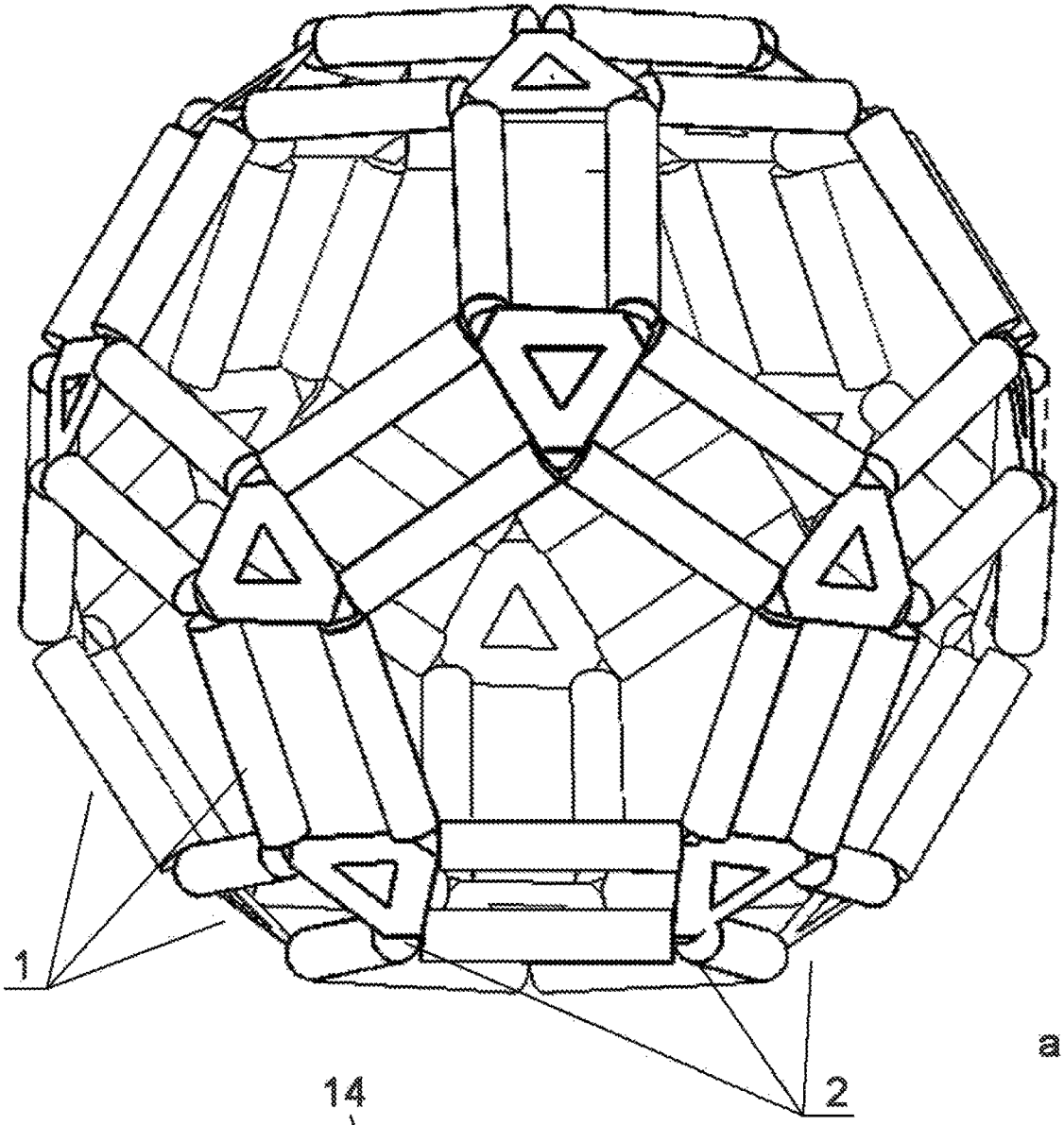
FIG. 14—second example of an assembled modular lighting system—three-dimensional construction in the shape similar to a sphere, a—the entire construction, b—only its connecting module in unconnected state.
Figure 14:
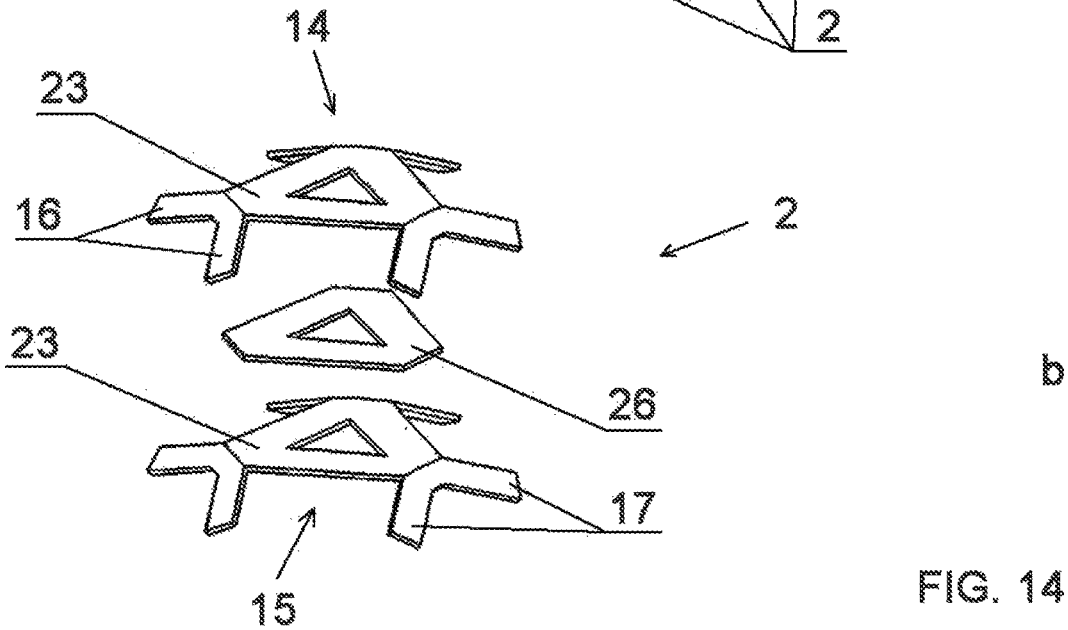

FIG. 14*a* depicts an example of an assembled modular lighting system—a three-dimensional construction in the shape of a figure similar to a ball. It is also made of cylinder LED modules 1 (figures depict only their outside shape) and connecting modules 2 (detailed depiction in FIG. 14*b*). Connecting module 2 comprises upper connecting element 14 and lower connecting element 15, each with a triangular base part 23 and six pins 16, 17 and the self-adhesive insulating spacer 25 between the base parts 23 of the connecting elements. Upper 14 and lower 15 connecting elements are identical.

In this example, connecting elements 14, 15 of more complex shape are shown, thus enabling to create an original modular lighting system in the shape of a ball. Manufacturing these connecting elements 14, 15, despite the complexity of their shape, remains unchanged compared to simpler connecting elements. Besides, changing the bend angle of pins 16, 17, from a kit of such LED modules 1 with connecting modules 2 a great number of other ball-shaped and differently shaped figures could be assembled.

This invention proposes modular lighting systems with a very simple type of electrical interconnection of LED modules. LED modules have an improved socket placement and simplified socket construction (the sockets are located one above the other on both ends of the module and have a flat shape), which gives the opportunity to greatly simplify the connecting modules. The production of connecting modules is very simple and unified for miscellaneous shapes, number of pins and their placement. This, in turn, together with the possibilities to bend the pins of connecting modules ensures a very wide range of possible diverse three-dimensional constructions of modular lighting systems, including diversifying the constructions of modular lighting systems made of the same particular modules.

The invention claimed is:

1. A modular lighting system, comprising a plurality of LED modules (1), and a plurality of connecting modules (2) for connecting corresponding ones of the LED modules (1), wherein each LED module (1) comprises an elongated body (3) which has two ends and is made of translucent and electrically insulating polymer material, wherein each body (3) along its longitudinal axis has a uniform shape of cross-section at least in a middle section, wherein upper openings (4*a*, 4*b*, 4) and lower openings (5*a*, 5*b*, 5) of rectangular cross-section are arranged along the longitudinal axis one above the other on each end (19, 20) of each body (3), wherein a shape and size of a cross-section of the upper openings (4*a*, 4) on one end of each respective body corresponds to a shape and size of a cross-section of the upper openings (4*b*, 4) on the other end of each respective body, while a shape and size of a cross-section of the lower openings (5*a*, 5) on one end of each respective body corresponds a shape and size of a cross-section of the lower openings (5*b*, 5) on the other end of each respective body, wherein distances between a longer edge of the cross-section of the upper openings (4*a*, 4*b*, 4) and a longer edge of the cross-section of the lower openings (5*a*, 5*b*, 5) throughout a length of the openings (4*a*, 4*b*, 4, 5*a*, 5*b*, 5) and on both ends of each respective body (3) are the same, wherein an internal surface of the upper openings (4*a*, 4*b*, 4) is at least partially made to be electrically conductive to create upper sockets (7 8), wherein an internal surface of the lower openings (5*a*, 5*b*, 5) is at least partially made to be electrically conductive to create lower sockets (9, 10) (7, 8, 9, 10), wherein an upper socket (7) located on one end of each respective body (3) is electrically connected with an upper socket (8) located on the other end of the respective body (3), wherein a lower socket (9) located on one end of each respective body (3) is electrically connected with a lower socket (10) located on the other end of the respective body (3), wherein inside each respective body (3) at least one LED element (11) is located, which is directly or indirectly electrically connected to an electrical conductor material (6) of the upper sockets and to an electrical conductor material (18) of the lower sockets (9, 10) of the respective body (3), wherein each connecting module (2) comprises two corresponding with each other one-piece connecting elements (14, 15) made from a metal sheet and intended for electrical and mechanical connection of the corresponding LED modules (1), each of said connecting elements having at least three bendable pins (16, 17), and wherein the shape of the pins (16) of an upper connecting element (14) of the connecting elements (14,15) of each connecting module (2) corresponds to the shape and size of the upper sockets (7, 8) of the corresponding LED modules (1), while the shape of the pins (17) of a lower connecting element (15) of the connecting elements (14,15) of each connecting module (2) corresponds to the shape and size of the lower sockets (9, 10) of the corresponding LED modules (1).

2. The modular lighting system according to claim 1, wherein a height of the sockets (7, 8, 9, 10) of the LED modules (1) and a height of pins (16, 17) of the connecting elements (14, 15) is between 0.3 and 3.00 mm, wherein a width of the sockets (7, 8, 9, 10) of the LED modules (1) is at least 3 times bigger than the height of the sockets (7, 8, 9, 10), and wherein a width of the pins (16, 17) of the connecting elements (14, 15) is at least 3 times bigger than the height of the pins (16, 17), while a length of the pins (16, 17) of the connecting elements (14, 15) is at least 2 times bigger than the width of the pins (16,17).

3. The modular lighting system according to claim 2, wherein the upper (4) and lower (5) openings of the LED modules (1) extend throughout an entire length of the respective body (3).

4. The modular lighting system according to claim 1, wherein the upper (4) and lower (5) openings of the LED modules (1) extend throughout an entire length of the respective body (3).

5. The modular lighting system according to claim 1, wherein the upper (7, 8) and lower (9, 10) sockets of the corresponding LED modules (1) and accordingly the pins (16, 17) of the upper and lower connecting elements (14, 15) of the connecting module (2) are made of different width.

6. The modular lighting system according to claim 1, wherein the cross-section of the body (3) of the each of the LED modules (1) has a circular shape.

7. The modular lighting system according to claim 1, wherein the cross-section of the body (3) of the each of the LED modules (1) has a polygonal shape.

8. The modular lighting system according to claim 1, wherein at least one connecting element (14, 15) of each connecting module (2) has an electrically insulating layer at least on the surface which is directed towards the other connecting element (15, 14) of each connecting module (2).

9. The modular lighting system according to claim 1, wherein the connecting elements (14, 15) of each connecting module (2) are fastened together.

10. The modular lighting system in according to claim 1, wherein surfaces of both ends (19, 20) of the body of each of the respective LED modules (1) are arranged at an angle to the longitudinal axis of the respective LED module (1).

11. The modular lighting system according to claim 1, wherein elements are placed in the body (3) of the LED module (1) or on a surface of the body (3) of each respective LED module (1) to change the optical transmittance of the body (3) of the respective LED module (1).

12. A modular lighting system, comprising a plurality of LED modules (1), and a plurality of connecting modules (2) for connecting corresponding ones of the LED modules (1), wherein each LED module (1) comprises an elongated body (3) which has two ends and is made of translucent and electrically insulating polymer material, wherein each body (3) along its longitudinal axis has a uniform shape of cross-section at least in a middle section, wherein upper openings (4*a*, 4*b*, 4) and lower openings (5*a*, 5*b*, 5) of rectangular cross-section are arranged along the longitudinal axis one above the other on each end (19, 20) of each body (3), wherein a shape and size of a cross-section of the upper openings (4*a*, 4) on one end of each respective body corresponds to a shape and size of a cross-section of the upper openings (4*b*, 4) on the other end of each respective body, while a shape and size of a cross-section of the lower openings (5*a*, 5) on one end of each respective body corresponds a shape and size of a cross-section of the lower openings (5*b*, 5) on the other end of each respective body, wherein distances between a longer edge of the cross-section of the upper openings (4*a*, 4*b*, 4) and a longer edge of the cross-section of the lower openings (5*a*, 5*b*, 5) throughout a length of the openings (4*a*, 4*b*, 4, 5*a*, 5*b*, 5) and on both ends of each respective body (3) are the same, wherein an internal surface of the upper openings (4*a*, 4*b*, 4) is at least partially made to be electrically conductive to create upper sockets (7, 8), wherein an internal surface of lower openings (5*a*, 5*b*, 5) is at least partially made to be electrically conductive to create lower sockets (9, 10), wherein an upper socket (7) located on one end of each respective body (3) is electrically connected with an upper socket (8) located on the other end of the respective body (3), wherein a lower socket (9) located on one end of each respective body (3) is electrically connected with a lower socket (10) located on the other end of the respective body (3), wherein inside each respective body (3) at least one LED element (11) is located, which is directly or indirectly electrically connected to an electrical conductor material (6) of the upper sockets and to an electrical conductor material (18) of the lower sockets (9, 10) of the respective body (3), wherein each connecting module (2) comprises two corresponding with each other one-piece connecting elements (14, 15) made from a metal sheet and intended for electrical and mechanical connection of the corresponding LED modules (1), each of said connecting elements having at least three bendable pins (16, 17), and wherein the shape of the pins (16) of an upper connecting element (14) of the connecting elements (14,15) of each connecting module (2) corresponds to the shape and size of the upper sockets (7, 8) of the corresponding LED modules (1), while the shape of the pins (17) of a lower connecting element (15) of the connecting elements (14,15) of each connecting module (2) corresponds to the shape and size of the lower sockets (9, 10) of the corresponding LED modules (1), wherein a height of the sockets (7, 8, 9, 10) of the LED modules (1) and a height of pins (16, 17) of the connecting elements (14, 15) is between 0.3 and 3.00 mm, wherein a width of the sockets (7, 8, 9, 10) of the LED modules (1) is at least 3 times bigger than the height of the sockets (7, 8, 9, 10), and wherein a width of the pins (16, 17) of the connecting elements (14, 15) is at least 3 times bigger than the height of the pins (16, 17), while a length of the pins (16, 17) of the connecting elements (14, 15) is at least 2 times bigger than the width of the pins (16,17), wherein the upper (4) and lower (5) openings of the LED modules (1) extend throughout an entire length of each respective body (3), wherein the cross-section of the body (3) of the each of the LED modules (1) has a circular or polygonal shape, and wherein surfaces of both ends (19, 20) of the each respective LED module (1) are arranged at an angle to the longitudinal axis of the respective LED module (1).

13. The modular lighting system according to claim 12, wherein elements placed in the body (3) or on a surface of the body (3) of each respective LED module (1) change the optical transmittance of the body (3) of the respective LED module (1).

* * * * *